FT25102 08 4,103,237

United States
Fischer

X5230A

4,103,237
Jul. 25, 1978

[54] RADIO JAMMING SYSTEM

[75] Inventor: Laurin G. Fischer, Glen Rock, N.J.

[73] Assignee: International Telephone & Telegraph Corp., Nutley, N.J.

[21] Appl. No.: 553,352

[22] Filed: Dec. 15, 1955

[51] Int. Cl.[2] ..... H04K 3/00
[52] U.S. Cl. ..... 325/132; 325/6
[58] Field of Search ..... 250/17, 15, 15 T; 343/18, 18 E; 325/132, 1, 6

[56] References Cited

U.S. PATENT DOCUMENTS

| | | | |
|---|---|---|---|
| 1,877,815 | 9/1932 | Conrad | 250/15 |
| 2,412,991 | 12/1946 | Labin | 250/17 |
| 2,424,156 | 7/1947 | Espley | 250/13 |
| 2,425,315 | 8/1947 | Atwood et al. | 250/15 |
| 2,440,253 | 4/1948 | Dodington | 343/18 |
| 2,477,585 | 8/1949 | Dodington | 250/15 |
| 2,943,318 | 6/1960 | Deloraine et al. | 325/6 |
| 2,978,699 | 4/1961 | Dodington | 325/6 |
| 3,007,159 | 10/1961 | Dodington | 325/6 |
| 3,015,096 | 12/1961 | Deloraine et al. | 325/6 |

*Primary Examiner*—Howard A. Birmiel
*Attorney, Agent, or Firm*—John T. O'Halloran

EXEMPLARY CLAIM

1. A repeater comprising an antenna system, a repeater loop consisting solely of broadband elements for coupling the input signal from the input to the output thereof without changing the frequency of the signal at any place in the loop, said elements including at least one broadband translation device, means coupling the input and output of said repeater loop to said antenna system to receive incoming signals and for retransmitting said signals, and means for communicating through said repeater including a source of local intelligence signals, a source of a local carrier wave, means coupling said wave source to said loop at a point ahead of said translation device and means coupling the source of local intelligence signals to said translation device to modulate said local carrier wave.

7 Claims, 1 Drawing Figure

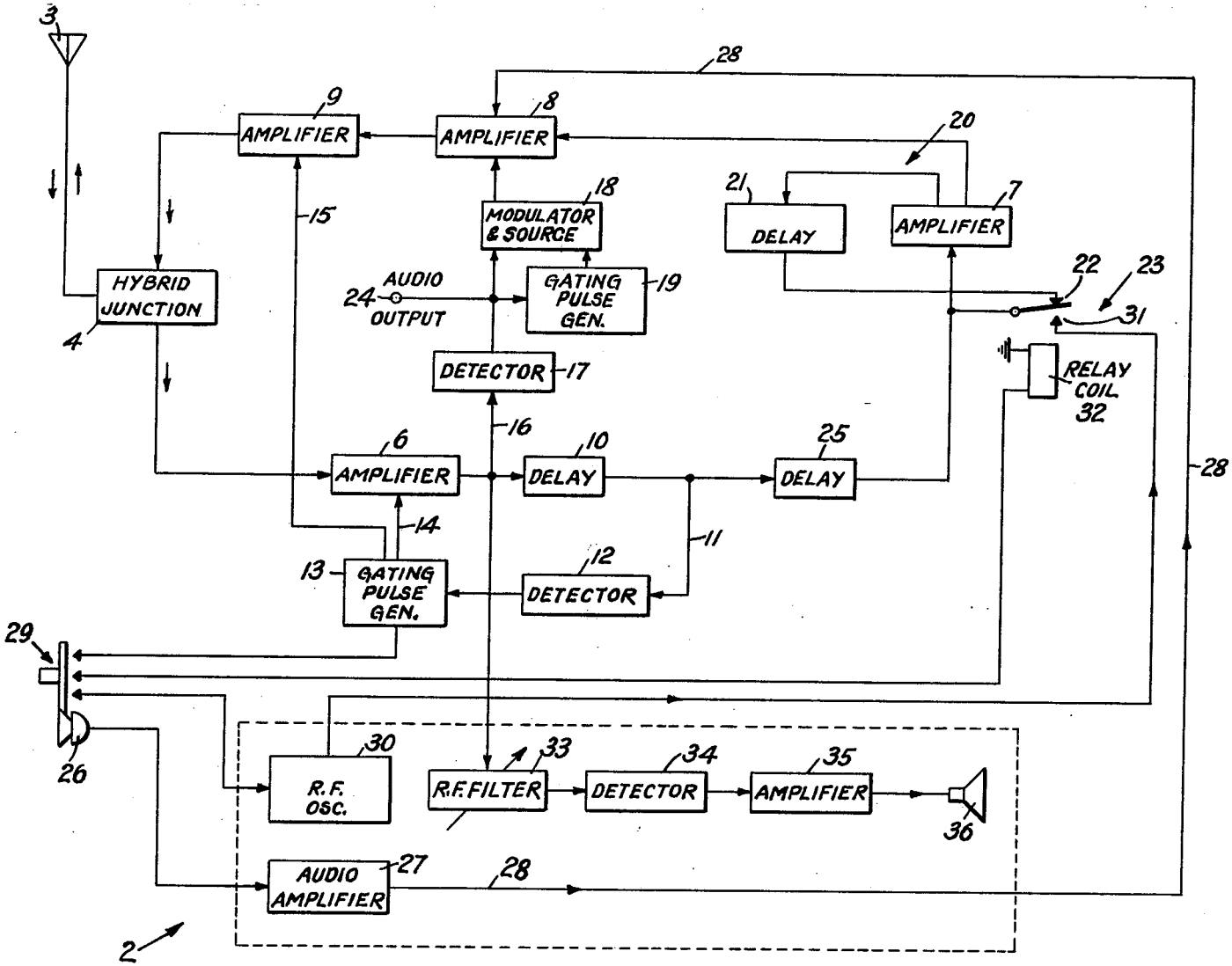
AMPLIFIER
DELAY
RELAY COIL
AMPLIFIER
MODULATOR & SOURCE
GATING PULSE GEN.
DETECTOR
DELAY
DETECTOR
AUDIO OUTPUT
AMPLIFIER
GATING PULSE GEN.
AMPLIFIER
HYBRID JUNCTION
R.F. FILTER
DETECTOR
AMPLIFIER
R.F. OSC.
AUDIO AMPLIFIER

RADIO JAMMING SYSTEM

This invention relates to a radio repeater system, particularly to one used for jamming. The invention further relates to such a jamming system which also provides communication facilities.

Jamming systems may be roughly grouped into two types: those in which locally generated noise is transmitted with high power, frequently over a very wide band; and those in which the signal to be jammed is repeated, with suitable distortion thereof to make interpretation of the original signal difficult. This, for example, in the second type the repeated signal is modulated in accordance with observed psycho-acoustical characteristics to render difficult the interpretation of the mixture of the original signal and the distorted repeated signal. If the original signal is modulated according to a speech pattern, the repeated signal may be modulated with a signal that has something of the nature of speech, but differs from the intelligence in the original signal.

Repeator jamming systems of the type hereinabove described may be used for jamming signals between a ground station and an airplane, and for this purpose it may be desirable that the jamming system be mounted in another airplane. Such jamming systems have a plurality of contradictory requirements. Since they repeat a signal, they must have an antenna for receiving the signal and an antenna for retransmitting it. The receiver of such jamming systems must be kept open normally, so as to quickly detect and respond to a signal. If, however, separate receiving and transmitting antennas are employed, the two antennas must be isolated so that feedback from the transmitting antenna to the receiving antenna will not set up oscillations in the system itself. This is difficult to accomplish where both antennas must be mounted on the same airplane.

An object of the present invention is the provision of a repeater-type system using either a single antenna for both transmitting and receiving or using two separate antennas whose mutual coupling would tend to result in oscillation, and having means for preventing oscillation of the system while at the same time providing a receiving arrangement which is normally open to detect an incoming signal.

In order to provide a channel of communication within the band in which jamming occurs, it has been suggested that a small section of the band be set aside for communication purposes leaving the rest of the relatively broadband of the jamming system available for jamming purposes. An obvious objection to this is that hostile communication will be able to detect this channel and, by tuning thereto, use its facilities without being jammed.

Another object of the present invention is the provision of a jamming system of the type hereinabove described in which provision is made for communication without opening a channel for use by hostile communication.

According to one feature of the present invention, the jamming system is arranged so that it receives signals to be jammed over a relatively wide band of frequencies and without changing the carrier frequency amplifies the received signal, further modulates the received signal, with a distorting or masking modulation, and retrasmits the modulated original signal—the jamming signal—at its original carrier frequency. The receiver is normally open, and will receive over a wide band of frequencies. To prevent feedback from the output to the input of the system, whether this feedback results from the employment of a common signal antenna for both transmission and reception or whether this feedback is produced by coupling between the transmitting and receiving antennas, the system is so arranged that the transmitter is always blocked whenever the receiver is open. However, upon reception of an incoming signal the receiver is blocked after an interval, during which interval a portion of the incoming signal has been received. Reception remains blocked while the modulated original signal—the jamming signal—is transmitted, and then transmission halts, after which the system is again unblocked to incoming signals.

Other and further objects of the present invention will become apparent, and the foregoing will be better understood with reference to the following description of an embodiment thereof, reference being had to the drawing, in which the FIGURE is a block diagram of a jamming repeater system providing facilities for communication.

In carrying out the present invention there is provided an antenna system coupled to a repeater loop. If a single antenna is used for both transmission and reception, a hybrid junction is employed for coupling the repeater loop to the antenna. A plurality of wide band amplifiers are arranged in the loop. A delay device is also arranged in series in the loop, from whose output there is derived a voltage for blocking the repeater system between the input and said delay device, while opening up the repeater system from between the delay device and the output. For jamming purposes the repeated wave is remodulated with a distorting signal. One way in which the distorting signal may be obtained is by detecting the incoming signal to separate the modulation thereof, distorting this modulation and remodulating the original wave with a distorted modulation. Other ways of distorting include applying recorded distorting signals to remodulate the original wave.

Communication through the repeater system is accomplished by injecting into the loop a carrier wave from a local oscillator and modulating this wave in one of the amplifiers of the loop. The system is arranged so that an incoming signal may be received and repeated as a jamming signal, while communication is carried on over a narrow channel in the broadband spectrum of the repeater loop.

Referring now specifically to the drawing, there is disclosed a repeater system 1 having associated therewith communication facilities 2.

The repeater system includes an antenna system in the form of a single antenna 3 used for both transmitting and receiving. Antenna 3 is coupled by suitable means, such as a hybrid junction 4, for example, a directional coupler, to a repeater loop having a plurality of amplifier stages 6, 7, 8 and 9 arranged therein. A delay device 10 is arranged in the loop between amplifiers 6 and 7. For the purpose of preventing the system from self-oscillation, a part of the energy at the delay device 10 is fed via a line 11 to a detector 12, whose output is connected to a gating pulse generator 13 triggered by output energy from detector 12 and which thereby applies a blocking voltage over line 14 to amplifier 6, while at the same time applying an unblocking voltage over line 15 to amplifier 9. The gating pulse generator 13 normally operates as a monostable device and a given interval after being tripped, reverts to its original condition in which amplifier 6 is unblocked and amplifier 9 again blocked. The output of amplifier 6 is also fed via a line 16 through a detector 17 to a modulator and distorting signal source 18. In modulator 18 the detected intelligence (the modulation) of the incoming signal is distorted. Various forms of distortion may be employed, such as recording in a forward direction and retransmitting in reverse, mixing with other recordings, or the substitution of other recordings. To actuate these recording and storage devices, the output of detector 17 may also be applied to a gating pulse generator 19, whose output is used to initiate reading of other records or storing and reading off of the signal received from detector 17. The output of the modulator 18 is used to remodulate or, rather, further modulate the signal passed through amplifier 7, which is the delayed incoming signal. For jamming purposes it is desirable to have the transmitter duty cycle high, such as 80 or 90 percent, and therefore reception occurs only during a small percentage, say 10 to 20 percent, of the duty cycle. In order to have transmission occurring during 80 to 90 percent of the time, it is necessary to repeat each of the relatively short portions of the incoming signal a number of times to stretch it out to fill in the rest of the duty cycle during which transmission should occur. For this purpose there is provided a reiterating circuit 20 around amplifier 7, the circuit comprising a delay device 21 connected between the output of amplifier 7 and the input thereof, the delay having a valve at least equal to the delay in device 10 so as to enable reiterating the signal without regeneration. The delay 21 is connected to the input of amplifier 7 via the back contact 22 of a relay 23, whose function will be described more fully hereinafter. Some further distortion may also be introduced by this reiteration of the signal.

With respect to further details of the jamming system, the incoming signal may be monitored by taking the output of detector 17 from an output terminal 24 and applying it to a suitable monitoring device, such as a loudspeaker, meter or cathode-ray tube. A delay device 25, introducing a small delay, is preferably arranged after delay 10 so as to enable the power amplifier 9 to be turned on before the signal at the output of amplifier 10 is fed thereto via amplifiers 7 and 8.

Communication facilities for the jamming repeater system are provided as follows. A microphone 26 is connected to an audio amplifier 27 whose output is in turn applied over a line 28 to modulate energy passing through amplifier 8. The microphone 26 is provided with a "push-to-talk" button 29 which turns on a r-f oscillator 30 whose output is connected to the front contact 31 of relay 23, the button 29 also energizing the relay coil 32 of relay 23 to disconnect the back contact 22 and connect the front contact 31 to the input of amplifier 7. This injects the local oscillations into the repeater loop at amplifier 7, these oscillations being then modulated in amplifier 8 and amplified in amplifier 9 and transmitted to the antenna 3. The button 29 is also connected to gating pulse generator 13 to cause it to oscillate or produce output pulses at a predetermined rate. Thus, for example, the gating pulse generator 13 which acts as a monostable device may be made astable or free-running, as by removing the bias making it monostable, to cause it to generate pulses, thereby turning amplifier 6 on and off repeatedly, with amplifier 9 being also turned on and off in reverse fashion. This enables the normal jamming operation to continue while the communication facilities are being used.

For receiving an incoming communication, the output of amplifier 6 is fed through an r-f filter 33 tuned to the frequency at which reception is to be had, the output of filter 33 being detected in detector 34, amplified in amplifier 35 and applied to a suitable utilization device, such as a speaker 36.

The operation of the foregoing system is as follows. An incoming signal, consisting of a carrier modulated in accordance with intelligence, is received on antenna 3 and fed through hybrid junction 4 and amplifier 6 to delay device 10. After a predetermined interval determined by the value of the delay 10, the beginning of the received signal passes out of the delay device and through line 11 into the detector 12. The output of detector 12 triggers gating pulse generator 13, blocking amplifier 6 while unblocking amplifier 9. The output of delay device 10, also without being detected, after a slightly further delay in delay device 25, passes through amplifiers 8 and 9 which successively amplify the signal more and more, the output of amplifier 9 being applied through hybrid junction 4 to antenna 3 for radiation. The energy passing through amplifier 8 is further modulated by the output of modulator 18. Modulator 18 is fed with the detected input signal from the input amplifier 6 via detector 17, this intelligence being stored and distorted in modulator 18, in accordance with known techniques, and then being impressed upon amplifier 8 as the signal being fed around the repeater loop passes through said amplifier 8. Stretching of the signal to fill up the transmission time of the duty cycle is produced by reiterating it in amplifier 7 a given number of times. It is preferred that the loop be open to receive input signals for a minor fraction of the total duty cycle such as, for example, an eighth of the time. In the rest of the duty cycle the system repeats the incoming signal, with proper distortion to disguise the message.

The amplifiers 6 through 9, and indeed the whole repeating loop, are broadband and it is to be noted that the original signal is not detected in the loop itself, but is merely amplified and further distorted without changing the basic carrier frequency. For communication purposes only a small portion of the broadband of the repeater system is used, the local oscillator 30 injecting into the loop a carrier frequency within said broadband. The locally injected carrier frequency and modulation do not use the broad bandwidth of the system and, therefore, since the communication channel is relatively narrow band, the rest of the system is available for its initial jamming function. When communicating, the ringing delay device 21 is disconnected to prevent obscuring the message. It is to be noted that if while communication is occurring, an incoming signal is received on a different frequency and one which is to be jammed, it will pass through the amplifier 6 when said amplifier is opened by gating generator 13, pass through the delay networks 10 and 25 and through the rest of the loop, and will be distorted by modulator 18 in a manner heretofore described. It will also be additionally distorted by the voice signal from microphone 26, which modulates all energy passing through amplifier 8, both the communication frequency and the signal frequency to be jammed. It will thus be seen that communication can be simultaneously carried on while providing for jamming a hostile communication, except in the unlikely event that the signal to be jammed is on the same frequency channel as the desired communication channel. In the latter event the communication channel would be jammed. However, by returning the local oscillator 13 this can be readily avoided.

While amplifiers 6 through 9 may consist of single stages, one or more of them may also be a multi-stage amplifier and for gating purposes, the latter is preferred with multi-stage blocking instead of single-stage blocking. Furthermore, it will be seen that the modulation of both the jamming and the communication channel signals may be either frequency modulated or amplitude modulated.

While I have described above the principles of my invention in connection with specific apparatus, it is to be clearly understood that this description is made only by way of example and not as a limitation to the scope of my invention as set forth in the objects thereof and in the accompanying claims.

I claim:

1. A repeater comprising an antenna system, a repeater loop consisting solely of broadband elements for coupling the input signal from the input to the output thereof without changing the frequency of the signal at any place in the loop, said elements including at least one broadband translation device, means coupling the input and output of said repeater loop to said antenna system to receive incoming signals and for retransmitting said signals, and means for communicating through said repeater including a source of local intelligence signals, a source of a local carrier wave, means coupling said wave source to said loop at a point ahead of said translation device and means coupling the source of local intelligence signals to said translation device to modulate said local carrier wave.

2. A repeater according to claim 1 further including means for blocking said loop at a point ahead of the point at which said carrier wave is injected during the injection of said carrier wave.

3. A jamming system according to claim 2, wherein said means for communicating includes a receiver coupled to said repeater system and tunable to receive signals over a channel within the broadband of said repeater system.

4. A jamming system for jamming signals consisting of a carrier modulated according to intelligence comprising an antenna system, a repeater loop, means coupling the input and output of said repeater loop to said antenna system to receive the signals to be jammed and for retransmitting said signals, a storage delay device in series in said repeater loop, means, including a monostable trigger device whose input is coupled to the output of said delay device normally blocking said repeater loop at a first point after said delay device and unblocking said repeater loop at a second point before said delay device, said means being responsive to the initial portion of a signal passing through said delay device to reverse for a given fixed time interval said blocking and unblocking of said first and second points, whereby a portion of the incoming signal is isolated in said delay device from the remainder thereof, means in said repeater loop after said delay device for reiterating said isolated portion of said signal a plurality of times during a second time interval, and means for applying said plurality of reiterations of said isolated portion to said antenna coupling means for transmission during said second interval.

5. A jamming system according to claim 4 in which said reiterating means comprises a signal translator in series in said repeater loop, and a recirculating line including a delay means in series therein coupled between the output and input of said translator and having a delay at least equal to that of said storage delay device.

6. A jamming system according to claim 4 further including means in said repeater loop for distorting the intelligence-bearing modulation of the incoming signal comprising means for detecting the intelligence-bearing modulation of the incoming signal, means for distorting the detected modulation, and means for applying the distorted detected modulation to said repeater loop at a point after said delay device to remodulate the signals passing through said repeater loop.

7. A jamming system for jamming signals consisting of a carrier modulated according to intelligence comprising an antenna system, a repeater loop consisting solely of broadband elements for coupling the input signal from the input of said loop to the output thereof without changing the frequency of said signal at any place in the loop, said elements including at least one broadband amplifier means coupling the input and output of said repeater loop to said antenna system to receive the signals to be jammed and for retransmitting said signals, means in said repeater loop for distorting the intelligence-bearing modulation of the incoming signal, means coupled to said loop for isolating a portion of the input signal which is received during a given interval, and means coupled to said loop at a point after said isolating means for reiterating a number of times said isolated portion and transmitting it during a second interval which is at least said number of times greater than said first interval.

* * * * *